United States Patent [19]

Amos

[11] Patent Number: 4,801,009

[45] Date of Patent: Jan. 31, 1989

[54] TWO COMPARTMENT CONTAINER FOR MIXING

[75] Inventor: Walter Amos, Wiesbaden, Fed. Rep. of Germany

[73] Assignee: Blendax-Werke Schneider GmbH & Company, Fed. Rep. of Germany

[21] Appl. No.: 101,374

[22] Filed: Sep. 25, 1987

[30] Foreign Application Priority Data

Oct. 8, 1986 [DE] Fed. Rep. of Germany ..... 3634264

[51] Int. Cl.[4] ..... B65D 25/08

[52] U.S. Cl. ..... 206/222

[58] Field of Search ..... 206/222, 219; 215/DIG.8

[56] References Cited

U.S. PATENT DOCUMENTS 3,802,604 4/1974 Morane et al. ..... 206/222 X
4,465,183 8/1984 Saito et al. ..... 206/222

FOREIGN PATENT DOCUMENTS 2294937 7/1976 France ..... 206/222
2506726 12/1982 France ..... 206/222

*Primary Examiner*—William Price
*Attorney, Agent, or Firm*—Connolly & Hutz

[57] ABSTRACT

A container which can be easily filled and handled for the packing of two compositons which must be separately kept until mixed shortly before use, consists of two separate chambers which are arranged one upon the other in a packing unit. The upper chamber is provided with a closeable orifice for the delivery of the mixture. An intermediate part is arranged between the two chambers and such part has cutting edges or sharp mandrels on both sides thereof which allow the two compositions being separately kept to be mixed by cutting the bottom part of the upper chamber and the upper part of the bottom chamber when the container is pressed or screwed together.

1 Claim, 1 Drawing Sheet

TWO COMPARTMENT CONTAINER FOR MIXING

BACKGROUND OF THE INVENTION

The present invention relates to a container for the packing of two compositions which must be separately kept until being mixed shortly before use.

Two compartment containers have long been known. Normally, they consist of two separate chambers which are arranged one upon the other in a packing unit. The upper chamber is provided with a closeable orifice for the delivery of the mixture. Both containers are separated by a separating foil which is penetrated by a sharp-edged punching tool in the container, when the containers are screwed or pressed together. This allows the container contents to mix shortly before use. Such a two compartment packing unit is described in German Pat. No. 2,760,079.

Further arrangements of known two compartment containers are disclosed in German Offenlegungsschriften Nos. 2,451,167, 1,536,305, 2,211,753, and 2,539,231, U.S. Pat. Nos. 3,521,745 and 3,548,562, and German Utility Model No. 7317067.

The filling of two comparment packings with the compositions to be separately kept until their use is normally effected in such a way that first the bottom container is filled with the corresponding product, then its opening is welded with a separating foil to the upper container which is then filled and closed. Such a procedure consisting of several steps is rather complicated and expensive.

Another disadvantage of the known two compartment containers is that the opening mechanism, i.e. a mandrel or a corresponding cutting edge causing the penetration of the separating foil, has to be fixed in one of the two chambers and is thus permanently in contact with its filling. This might cause unwanted modifications of the product when it is stored for a long time. Thus, there existed a need to develop a two chamber packing which does not have these disadvantages.

SUMMARY OF THE INVENTION

It has now been found that in case of two compartment containers according to the above described type, these disadvantages can be avoided according to the present invention. Between the two chambers an intermediate link is arranged provided on both sides with cutting edges or mandrels, which when the two chambers are pressed or screwed together, simultaneously cut the bottom part of the upper chamber and the upper part of the bottom chamber. This allows the separately kept compositions to be mixed together and then subsequently released from the container as the product mixture.

BRIEF DESCRIPTION OF THE DRAWINGS

Novel features and advantages of the present invention in addition to those noted above will become apparent to those of ordinary skill in the art from a reading of the following detailed description in conjunction with the accompanying drawings wherein similar reference characters refer to similar parts and in which.

DETAILED DESCRIPTION OF THE INVENTION

Figure 1:
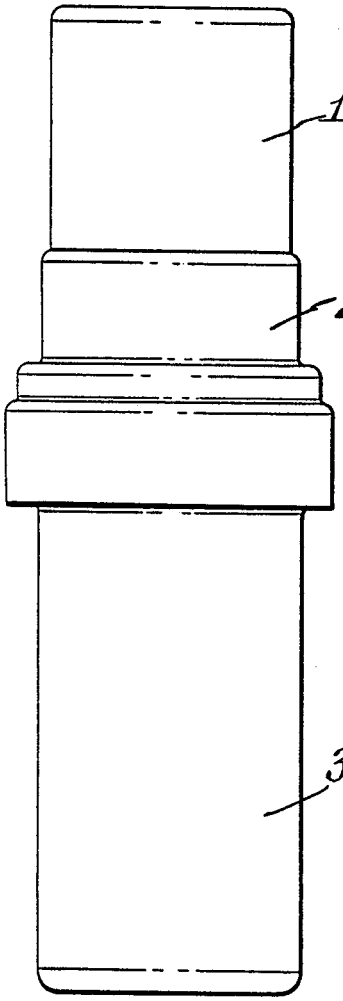
FIG. 1 is a side elevational view of a two compartment container, according to the present invention.

FIG. 1 illustrates an integrated two compartment container having a screw cap 1 arranged on top of an upper container compartment 2. The two compartment container also includes a bottom container compartment 3 as well as an intermediate part 5 provided with a screw element containing an opening mechanism in the form of cutting edges or sharp mandrels on both sides.

The upper part 2 is connected with the bottom part 3 through the intermediate part 5 which is provided with two packing rings 4 and two cutting rings 8. The upper part 2 is sealed with a foil 6 at its bottom side and the bottom part 3 is sealed with foil 6 at its upper opening. This foil preferably consists of aluminum which is plastic-coated on both sides and connected to the container material by welding.

The upper part 2 has internal threads 9 which cooperate with external threads 7 on the lower part. With these cooperating threads the intermediate part 5 can be moved in such a way that the cutting elements 8 destroy the foils 6 thus allowing the contents of the container compartments 2 and 3 to be mixed.

The destruction of the foils 6 by the cutting elements 8 or analogously arranged mandrels might of course also be provided by an elastic arrangement of the intermediate part 5 which allows the containers being pressed together. Also, the upper part 2 does not have to be sealed by a screw cap, but might be closed by any known seal.

The two compartment container according to the invention is particularly suitable for the delivery of hair dyes on the basis of oxidation dyes and peroxides which must be separately kept until their use.

Figure 2:
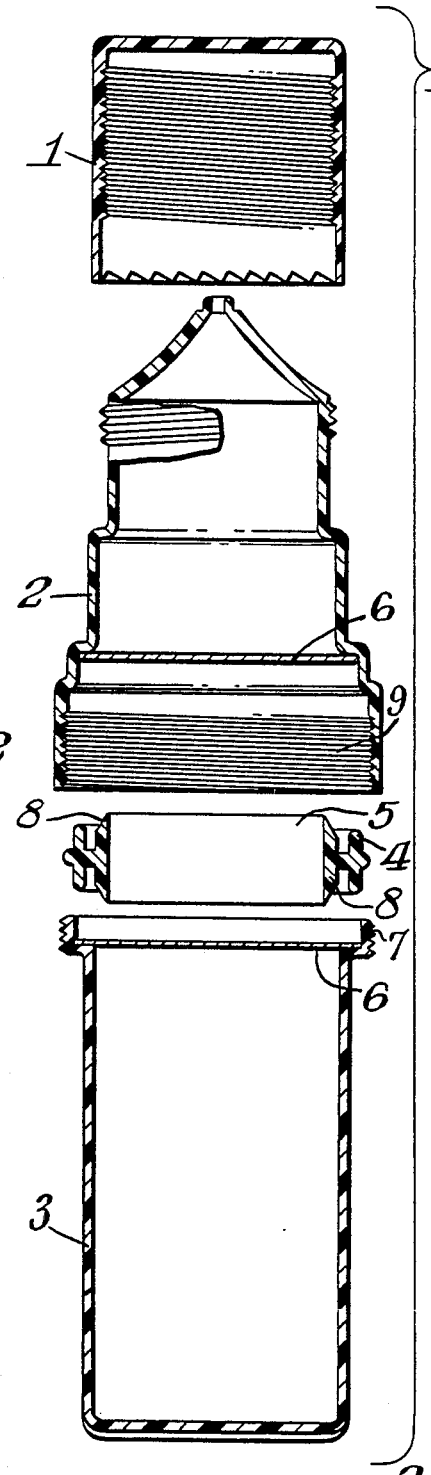
FIG. 2 is an exploded longitudinal sectional view of the container shown in FIG. 1.
Figure 3:
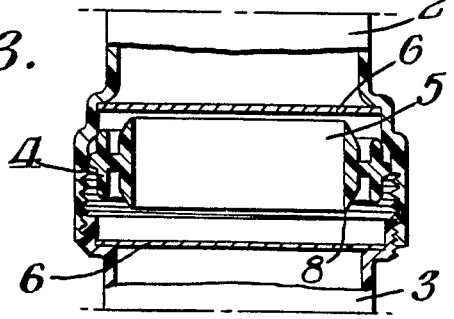
FIG. 3 is a partial longitudinal sectional view of the two compartment container of FIGS. 1 and 2 illustrating the container in its stored position prior to use.
Figure 4:
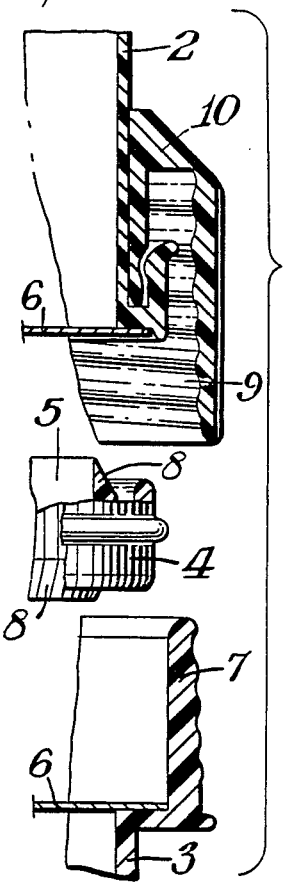
FIG. 4 is a partial exploded longitudinal sectional view of another embodiment of the invention.
Figure 5:
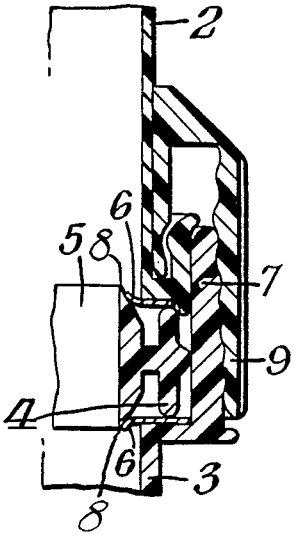
FIG. 5 is a partial longitudinal sectional view of the container of FIG. 4 illustrating the container in its stored position prior to use.

FIGS. 4 and 5 show an alternate embodiment of the invention wherein similar reference characters are used to identify similar parts. The upper and lower container compartments 2, 3 are sealed by foil 6 in the same manner as the two compartment container of FIGS. 1–3, and the intermediate part 5 is disposed between the foils. A rotatable operator or sleeve 10 is on the outside of upper part 2. Sleeve 10 has internal threads 9 that cooperate with external threads 7 on the lower part 3, and the sleeve is constructed and arranged to rotate relative to both the upper and lower parts. When the sleeve 10 is rotated, the upper and lower container compartments are drawn together until the cutting elements 8 pierce the foils 6 thereby allowing the contents to mix.

I claim:

1. A container for packing two compositions which must be separately kept until being mixed together shortly before use, the container consisting of two separate chambers arranged one upon the other and movable toward and away from one another, the upper chamber having a closeable orifice for delivery of the container contents, means sealing the upper and lower chambers including one seal for the upper chamber and another seal for the lower chamber, and an intermediate part arranged between the two chamber and the respective seals, the intermediate part having means for cutting the sealing means of the upper and lower chambers when the chambers are moved toward one another to thereby allow mixing of two compositions being separately kept, one composition in each of the two chambers, the means for cutting the sealing means including upper and lower cutting rings on the intermediate part, and the upper chamber having internal threads and the lower chamber including cooperating external threads whereby the chambers move toward one another by being screwed together to thereby urge the upper cutting ring into the seal on the upper chamber and the lower cutting ring into the seal on the lower chamber.

* * * * *